US007308743B2

(12) United States Patent
Fleissner

(10) Patent No.: US 7,308,743 B2
(45) Date of Patent: Dec. 18, 2007

(54) METHOD FOR EMBOSSED AND COLOURLESS DECORATION AND BONDING OF A FABRIC WEB AND DEVICE THEREFOR

(75) Inventor: Gerold Fleissner, Zug (CH)

(73) Assignee: Fleissner GmbH & Co. Maschinefabrik, Egelsbach (DE)

( * ) Notice: Subject to any disclaimer, the term of this patent is extended or adjusted under 35 U.S.C. 154(b) by 346 days.

(21) Appl. No.: 10/493,532

(22) PCT Filed: Oct. 21, 2002

(86) PCT No.: PCT/EP02/11747

§ 371 (c)(1),
(2), (4) Date: Feb. 28, 2005

(87) PCT Pub. No.: WO03/035955

PCT Pub. Date: May 1, 2003

(65) Prior Publication Data

US 2005/0155200 A1 Jul. 21, 2005

(30) Foreign Application Priority Data

Oct. 25, 2001 (DE) ..... 101 52 075

(51) Int. Cl.
*D04H 1/46* (2006.01)

(52) U.S. Cl. ..... 28/104; 28/167

(58) Field of Classification Search ..... 28/104, 28/105, 106, 167, 163; 492/30–34, 37, 49, 492/50, 28; 162/368, 372, 373
See application file for complete search history.

(56) References Cited

U.S. PATENT DOCUMENTS

| | | | | | |
|---|---|---|---|---|---|
| 3,590,453 | A * | 7/1971 | Bryand | 492/32 |
| 3,679,536 | A * | 7/1972 | Kalwaites | 28/105 |
| 3,681,184 | A * | 8/1972 | Kalwaites | 28/105 |
| 3,750,237 | A * | 8/1973 | Kalwaites | 28/105 |
| 3,787,932 | A * | 1/1974 | Kalwaites | 28/105 |
| 4,868,958 | A * | 9/1989 | Suzuki et al. | 28/104 |
| 5,042,722 | A * | 8/1991 | Randall et al. | 239/553.5 |
| 5,115,544 | A * | 5/1992 | Widen | 28/105 |
| 6,055,710 | A * | 5/2000 | Fleissner | 28/104 |
| 6,338,187 | B1 * | 1/2002 | Fleissner | 28/106 |
| 2002/0007540 | A1 * | 1/2002 | Black et al. | 28/105 |
| 2003/0088956 | A1 * | 5/2003 | Strandqvist et al. | 28/104 |
| 2003/0134560 | A1 * | 7/2003 | Bevan | 442/408 |
| 2005/0071966 | A1 * | 4/2005 | Barth et al. | 28/104 |

* cited by examiner

*Primary Examiner*—Amy B. Vanatta
(74) *Attorney, Agent, or Firm*—Antonelli, Terry, Stout & Kraus, LLP.

(57) ABSTRACT

A method for producing three-dimensional colourless designs in a non-woven fabric or like material entirely bonded includes subjecting the fibers to a blowing process through openings, since the fibers in the openings are only displaced therein with limited depth, and are subsequently needle bonded against a supplementary support.

6 Claims, 1 Drawing Sheet

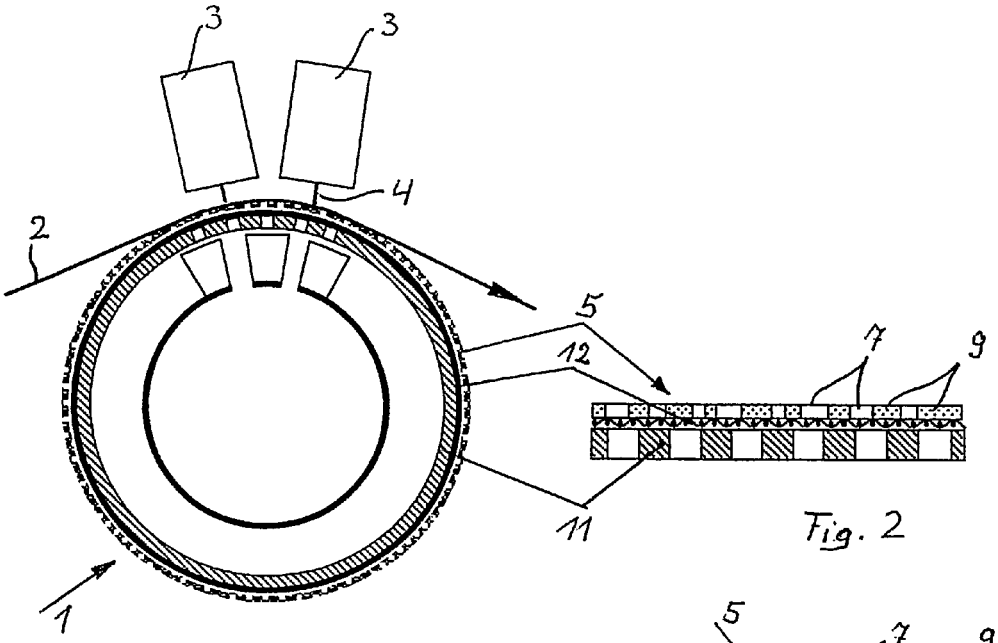
Fig. 1
Fig. 2
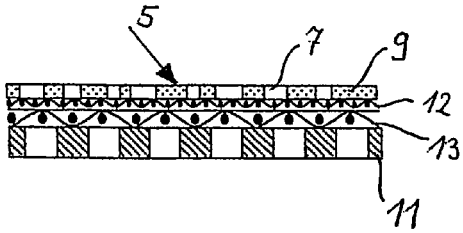
Fig. 3

METHOD FOR EMBOSSED AND COLOURLESS DECORATION AND BONDING OF A FABRIC WEB AND DEVICE THEREFOR

The invention relates to a method for colorless plastic patterning and strengthening of a fabric web of fibers that is not woven or knitted, i.e., of a nonwoven made up of substantially finite but also endless fibers such as synthetic staple fibers or also natural fibers.

U.S. Pat. No. 5,115,544 discloses provision of a screen with a number of profile-imparting elevations against which the nonwoven to be patterned is pressed by water jets. Depending on what figures are applied as elevations on the endless screen or bent into the screen, highly varied patterns, including perforated patterns, can be generated. The fibers are laterally displaced next to the elevations by the water jets, so that the elevations are substantially free of fibers. A similar disclosure is provided by EP-A-0 511 025, according to which elevations on a screen likewise ensure the colorless pattern. Here, hot air can also be employed as the medium for moving the fibers.

Further, DE-A-21 09 143 discloses moving a template with cutouts corresponding to the desired pattern over the fabric web, against which cutouts hot air is blown under pressure. However, this method, known from the color printing process, has likewise proved unsatisfactory. The same is true for the idea of DE-A-20 211 188—in which the patterning is effected by the template, likewise with hot air—that the air causes individual fibers of the pile-like fabric web to shrink as desired for the pattern.

In addition, reference should also be made to EP-A-0 423 619, according to which the fibers of a nonwoven are moved against a perforated drum by water jets in order to move the fibers into the holes of the perforated drum. In this way there results a nonwoven with a thin back and a front pattern side with fibers of the nonwoven there strongly concentrated in pattern fashion. The concentration of the fibers is undefinable in particular in the thickness of the nonwoven and the strengthening of the nonwoven is nearly equal to zero in the region of the pattern-fashion thickenings. The fibers of the nonwoven are shifted by the water jets into the recesses of the perforated drum in pattern fashion, but there is no strengthening of the fibers in the recesses.

Starting from the method of the type stated at the outset, the goal is to find a method by which, without great expense, a pattern can be continuously induced in the nonwoven or the like, which pattern is clearly defined in height as well, in which the moved fibers are likewise mutually interlaced and thus strengthened.

In order to achieve this goal, the invention provides that the fibers of the fabric web lying in a first plane provided with the intended pattern are partly displaced by high-energy water jets into a second plane and there held up against further displacement by an existing resistance, the impinging liquid is drained off, and the fibers of the fabric web in the two planes are intertwined with one another by the action of the water jets so that the nonwoven is strengthened over its entire area and with a pattern. Essential for clearly delimited patterning in a nonwoven uniformly strengthened over the entire area, similarly to a watermark in a paper, is the prevention of tearing of the nonwoven into two planes upon hydrodynamic needling. Strengthening should be the same everywhere, no holes of any kind should appear, and also the thickness of the nonwoven in the two planes should remain equal and invariant.

A device for carrying out the method is provided with a substrate present in the direction of the flowing water jets, which is only partly liquid-permeable and is open with a pattern. There, further, there is a pressurized-water bar assigned to this substrate for the production of fine water jets distributed over the working width. This device is now supplemented by a further substrate, likewise braced and liquid-permeable and provided as a supporting resistance for the fibers displaced by the pattern-imparting substrate, arranged beneath the pattern-imparting substrate. The device could advantageously be made up of a supporting, intrinsically stable, liquid-permeable drum such as a perforated drum, which is externally surrounded by a fine-meshed perforated belt such as a spun lace belt, and this by a pattern-imparting and likewise liquid-permeable belt or foil to which the pressurized-water bar is radially outwardly assigned. It is further advantageous to brace the spun lace belt on the perforated drum with a further, coarser screen fabric.

A device of the type according to the invention is depicted in exemplary fashion in the drawings, in which:

FIG. 1 shows in cross section a permeable perforated drum, held under suction, for production of a patterned nonwoven with the nozzle bar outwardly assigned to the perforated drum, and FIG. 2 shows the jacket of the perforated drum of FIG. 1 in enlarged depiction, and FIG. 3 shows the jacket of the perforated drum of FIG. 2 with supplemented structure.

Further peripheral components are also associated with perforated drum 1 visible in FIG. 1, but these are omitted here for the sake of clarity. Nonwoven 2 to be patterned runs directly over perforated drum 1, to which one or a plurality of nozzle bars 3 are directly externally assigned. Respective nozzle bar 3 is arranged axially parallel to perforated drum 1 and is provided, on its underside assigned to perforated drum 1, with a row of nozzles, not depicted here, for the discharge of water jets 4. As usual, perforated drum 1 is placed under suction for the extraction of the sprayed-on water, to which end a suction tube 8 is centrally arranged inside perforated drum 1, which suction tube has suction slots 10 extending to perforated drum 1, to which slots nozzle bars 3 are in turn assigned.

According to FIG. 1, perforated drum 1 is made up of a seamless perforated drum wall 11, which is provided as a backing element for further form elements slipped onto the outside. The holes of perforated drum wall 11 can be stamped into a metal sheet or the wall can have another stable structure. According to FIG. 2, a fine screen fabric, a spun lace belt 12, is slipped onto the perforated drum wall, onto which belt a metal sheet 5 provided with a pattern of holes is slipped in turn. Holes 7 are therefore drawn with various diameters. Of course, holes 7 can also have shapes other than round; any pattern, including a large-area pattern, is conceivable here.

If now water jets 4 impinge on nonwoven 2, which is smooth on both sides, the fibers in the region of holes 7 move into these holes and the nonwoven is needled and strengthened on webs 9 between holes 7. The motion of the fibers into holes 7 of thin patterned sheet 5 is limited, however, because a fine screen fabric 12 is arranged beneath patterned sheet 5, which screen fabric can be viewed as a spun lace belt in itself. Normally it serves as substrate for a nonwoven to be smoothly needled. The sprayed-on water penetrates through belt 12 and is extracted inside perforated drum 1. The fibers, however, remain lying on belt 12 and are also needled, i.e., strengthened, there by the water jets. In this way a plastic pattern arises on one side in a nonwoven strengthened over its entire area.

In FIG. 3 the structure of the perforated drum jacket is the same as in FIG. 2, but a coarser screen fabric 13 has been slipped in between spun lace belt 12 and supporting perforated drum wall 11, which coarser screen fabric increases the spacing between the supporting perforated drum surface and spun lace belt 12. This equalizes the water flow from screen belt 12 to the through-flow openings of perforated drum 11 and the webs between the through-flow openings no longer form an obstacle to the through flow.

The invention claimed is:

1. Method for colorless plastic patterning and strengthening of a nonwoven fabric web of fibers that is not woven or knitted, comprising:

providing a perforated drum, a coarse-meshed screen fabric externally surrounding the perforated drum, a fine meshed spun lace belt braced on the perforated drum via the coarse-meshed screen fabric that is interposed between the perforated drum and the fine meshed spun lace belt, and a pattern-imparting substrate, which is only partly liquid-permeable and is open with a pattern, externally surrounding the fine meshed spun lace belt;

providing a nonwoven fabric web over the pattern-imparting substrate; impinging high-energy water jets against an outer surface of the nonwoven fabric web, whereby fibers of the fabric web lying in a first plane provided with an intended pattern are partly displaced by impinging liquid in the high-energy water jets into a second plane and held up in the second plane against further displacement by the fine meshed spun lace belt; and draining the impinging liquid, whereby the fibers of the fabric web in the first and second planes are intertwined with one another by the action of the high-energy water jets so that the nonwoven fabric web is strengthened over its entire area and with a pattern.

2. Method according to claim 1, wherein the nonwoven fabric web comprises substantially finite fibers.

3. Method according to claim 2, wherein the substantially finite fibers comprise synthetic staple fibers.

4. Method according to claim 2, wherein the substantially finite fibers comprise natural fibers.

5. Device for carrying out the method of claim 1, comprising a perforated drum, a coarse-meshed screen fabric externally surrounding the perforated drum, a fine meshed spun lace belt braced on the perforated drum via the coarse-meshed screen fabric that is interposed between the perforated drum and the fine meshed spun lace belt, a pattern-imparting substrate, which is only partly liquid-permeable and is open with a pattern, externally surrounding the fine meshed spun lace belt, and a pressurized-water bar provided adjacent to the pattern-imparting substrate for the production of fine water jets distributed over a working width of the pressurized-water bar.

6. Device according to claim 5, wherein the perforated drum comprises a supporting, intrinsically stable, liquid-permeable drum, and the pressurized-water bar is provided radially outwardly from the perforated drum.

* * * * *